US005526758A

United States Patent [19]

Giammaruti et al.

[11] Patent Number: 5,526,758

[45] Date of Patent: Jun. 18, 1996

[54] DISTRIBUTION CONE FOR PULVERIZED COAL BURNERS

[75] Inventors: Robert J. Giammaruti, North Canton; Douglas M. Perry, Massillon, both of Ohio

[73] Assignee: The Babcock & Wilcox Company, New Orleans, La.

[21] Appl. No.: 333,394

[22] Filed: Nov. 2, 1994

[51] Int. Cl.[6] ..... F23D 1/00

[52] U.S. Cl. ..... 110/263; 110/261

[58] Field of Search ..... 110/260, 261, 110/263, 264, 265

[56] References Cited

U.S. PATENT DOCUMENTS

| | | | |
|---|---|---|---|
| 3,788,796 | 1/1974 | Krippene et al. | 431/2 |
| 4,057,021 | 11/1977 | Schoppe | 110/264 |
| 4,380,202 | 4/1983 | LaRue et al. | 110/263 |
| 4,448,135 | 5/1984 | Dougan et al. | 110/263 |
| 4,611,543 | 9/1986 | Collette | 110/263 |
| 4,934,384 | 6/1990 | Nitz et al. | 110/263 |
| 5,205,226 | 4/1993 | Kitto, Jr. et al. | 110/264 |

OTHER PUBLICATIONS

LaRue & Cioffi, "$No_x$ Control Update," B&W Technical paper, 1987, presented to Joint Symposium on Stationary Combustion $No_x$ Control, New Orleans, Louisiana, Mar. 23–27, 1987. Entire Paper.

Clark & LaRue, "Large Scale Testing and Development of the B&W Low $No_x$ Cell Burner," B&W Technical paper, 1987, presented to Joint Symposium on Stationary Combustion, New Orleans, Louisiana, Mar 23–27, 1987. Entire Paper.

Kitto, "Coal–Fired $No_x$ Emission Control Technologies," B&W Technical paper, 1989, presented to Sixth Annual International Pittsburgh Coal Conference, Pittsburgh, Pennsylvania, Sep. 25–29, 1989. Entire Paper.

*Steam: its generation and use,* publication of the Babcock & Wilcox Company, ©1992, Chap. 13: "Burners and Combustion Systems for Pulverized Coal", pp. 13–3 to 13–13.

*Primary Examiner*—Thomas E. Denion
*Attorney, Agent, or Firm*—Robert J. Edwards; Eric Marich

[57] ABSTRACT

A distribution half-cone for a granular or pulverized fuel, typically coal, burner is mounted within a burner nozzle thereof proximate to a burner elbow of the burner to provide a space or gap between an inner wall of the burner nozzle and the outer surface of the distribution half-cone of approximately 3/16 inch to prevent fuel roping and to minimize the pressure drop in the burner. The inlet of the distribution half-cone is formed as a sharp edge nozzle to minimize pressure drop in the burner.

38 Claims, 7 Drawing Sheets

DISTRIBUTION CONE FOR PULVERIZED COAL BURNERS

FIELD AND BACKGROUND OF THE INVENTION

The present invention relates generally to fuel burners and, more particularly, to pulverized coal fuel burners having burner nozzle coal diffusers or similar structures for efficiently breaking up, deflecting and dispersing pulverized coal fuel ropes that naturally occur within the burner piping.

Fossil fired steam generators are used in the utility power generation field to generate electricity. It is known that satisfactory combustion of pulverized coal fuel in such steam generators requires a higher percentage of excess air than other fuels such as gas or oil. One reason is the inherent maldistribution of the fuel provided to the combustion furnace of the steam generator, not only between individual burner pipes but also within and at the outlet of the burner discharge nozzles. Normally, complete combustion of a pulverized fuel such as coal requires at least 15% excess air. A significant amount of fan power is required just to provide this excess air. Enhanced fuel distribution could reduce excess air levels, with a concomitant reduction in fan power, so long as flame stability and emissions requirements are met.

Significant power consumption is also involved in overcoming the various pressure losses associated with pneumatic transport of the pulverized coal fuel within the fuel piping and burner nozzles. These pressure losses represent a significant operating cost, both at the stage when competitive bids are compared and evaluated, and also during subsequent plant operation. For this reason, it is also advantageous to reduce these pressure losses as much as possible, which will again reduce primary air fan power requirements.

One of the main causes of large pressure losses in the burner nozzle is related to the dispersion of fuel roping. Fuel roping is the concentration of a pulverized fuel such as coal in a relatively small area of the fuel transport pipe and burner nozzle, and is caused by the centrifugal flow patterns established by elbows and pipe bends in the fuel transport pipe and burner nozzle. The term "fuel roping" is used because the stream of coal transported takes the form of a thick, defined collection of coal particles that visually resembles a rope. Since the fuel transport pipe always makes a transition from a substantially vertical pipe run to a horizontal pipe run at the burners where the fuel is discharged into the furnace for combustion, fuel roping is generally unavoidable.

In the past, some pulverized fuel transport pipes and burner nozzles included a Venturi section which was meant to break up fuel roping and evenly disperse the pulverized fuel at an outlet end of the burner nozzle. U.S. Pat. No. 3,788,796 to Krippene et al., assigned to The Babcock & Wilcox Company, shows such a pulverized fuel burner including a Venturi section and a conical end-shaped rod member. The purpose of this combination was to vary the velocity of the coal-air mixture and to enhance the fuel-air distribution. This particular design was ineffective in reducing fuel roping and the pressure drop through the nozzle.

An improved fuel burner of the type disclosed in U.S. Pat. No. 3,788,796 is provided by U.S. Pat. No. 4,380,202 to LaRue et al., also assigned to The Babcock & Wilcox Company. Disclosed therein is a fuel burner apparatus for a vapor generating unit including a tubular nozzle which is concentrically disposed about the central axis of the burner. The inlet end of the nozzle is flow connected to an elbow pipe, and the nozzle conveys air entrained pulverized fuel for discharge into the combustion chamber of the vapor generating unit. A deflector shaped similar to the upper half of a frustoconical form is mounted on the top half of and angled downward from the inlet end of the tubular nozzle. The deflector creates a converging section within the nozzle. A diffuser having an oblong-diamond plug with ascending and descending sections and a shroud member is located within the nozzle. The cylindrical shroud is mounted to the inside of the tubular nozzle. The nozzle and shroud cooperate to form an outer annular fuel and air flow passageway therebetween, while the shroud and the plug cooperate to form a central annular fuel and air flow passageway therebetween. The central annular fuel and air flow-passageway has a converging inlet and a diverging outlet section. Support means are provided to support and position the diffuser shroud co-axially with the diffuser plug such that the diffuser shroud encircles the diffuser plug.

U.S. Pat. No. 4,380,202 to LaRue et al. is instructive for its discussion of various factors affecting burner nozzle pressure drop. As discussed therein, four main forces contribute to the pressure drop that occurs during the pneumatic conveying of the primary air and pulverized solids in the burner nozzle:

(1) The friction of the fluid against the pipe wall;

(2) The inertia force acting on the fluid;

(3) The inertia and gravity forces acting on the solids; and (4) The aerodynamic drag force acting on the solids.

In addition, areas of flow separation in the burner nozzle can also lead to pressure losses.

When fuel roping occurs, air flow distribution has a secondary effect on particle distribution. Once a particle attains momentum in a certain direction, it will change its direction of travel primarily by being impacted with a solid surface. Therefore, drag forces between the air and solid particles are of secondary importance, while the momentum (mass) of the particle is of primary importance. It is apparent from the foregoing that a reduction in the pressure drop through the burner nozzle can be accomplished by a reduction in any of the forces that contribute to the pressure drop and an elimination of flow separation. However, any attempt to reduce pressure losses must ensure adequate air-fuel mixing in order to provide flame stability and to meet applicable low $NO_x$ standards.

The aforementioned burners disclosed in the '796 and '202 patents are commonly referred to as dual register burners because they employ two sets of air registers or dampers to control admission of the secondary air (the balance of the air necessary for combustion and which is not used to transport the pulverized fuel) into the furnace. The dual register burner has been the subject of continued development, and finds its most recent embodiment in a design known as the DRB-XCL® burner, a registered trademark of The Babcock & Wilcox Company. The DRB-XCL® burner employs, inter alia, air and fuel staging technology, as well as various enhancements for secondary air control and measurement, together with the aforementioned conical diffuser and deflector within the burner nozzle.

In the drawings forming a part of this disclosure, like numerals designate the same or similar elements throughout the several drawings. FIG. 1 discloses a cross-sectional side view of such a dual register burner. As shown therein, the dual register burner 10 is comprised of a coal nozzle 12 which extends through a furnace windbox 14 inbetween a windbox cover plate 16 and a furnace wall 18. A mixture of primary air and pulverized coal 20 is provided to a coal inlet 22 to a burner elbow 24. The mixture 20 of primary air and pulverized coal is transported down along the coal nozzle 12, past a deflector plate 26 and a conical diffuser 28, towards an outlet end 30 of the dual register burner 10. A flame stabilizing ring 32 is provided at the outlet end 30 of the dual register burner 10, and combustion of the fuel and air takes place in furnace combustion chamber 34. Secondary combustion air 36 is provided to the furnace windbox 14 by fan means (not shown) and the amount of such secondary air 36 admitted to any given dual register burner 10 is controlled by means of a sliding air damper 38 and its associated damper drive 40. Total secondary combustion air 36 flow into the dual register burner 10 is measured by air measuring device 42, typically an arrangement of calibrated impact/suction probes, also called air flow monitors (AFM). Just prior to the outlet end 30 of the dual register burner 10, the secondary combustion air 36 is divided into two portions which are conveyed to the outlet end of the burner along inner and outer annular passageways 44 and 46 which encircle the coal nozzle 12. Accordingly, the portion of the secondary air conveyed through inner annular passageway 44 (which is closest to and which encircles the coal nozzle 12) is referred to as inner secondary air, while that portion of the secondary air which is conveyed through the outer annular passageway 46 (which encircles the inner annular passageway 44) is referred to as outer secondary air. Located within outer annular passageway 46 are fixed spin vanes 48 and adjustable spin vanes 50 used to impart a desired spin or swirl into the exiting secondary air 36 as it leaves the dual register burner 10. Fixed spin vanes 48 are only used in the outer annular passageway 46. Inner annular passageway 44 uses both fixed and adjustable spin vanes 48, 50. The position of adjustable spin vanes 50 can be varied by means of drive 52. The secondary air 36 exiting from the dual register burner 10 is also affected by the provision of an air separation plate 54 provided at the outlet end 30 of the dual register burner 10.

Another type of burner, traditionally referred to as a circular burner, predates these dual register burner types and was one of the earliest swirl-stabilized pulverized fuel burners, having been used for more than six decades. The circular burner differs from the dual register burner in two main respects. First, circular burners employ a single air register or damper to admit the secondary air. Second, circular burners firing pulverized fuel typically employ an impeller, located near and axially adjustable with respect to an outlet tip of the burner nozzle, which is used to disperse the primary air and pulverized fuel into the secondary air.

Various circular burner arrangements have been developed. One such arrangement is known in the industry as the cell burner, wherein two (and sometimes three) circular burners are combined in a vertically stacked assembly that operates as a single unit. FIG. 2 shows a two-high cell burner arrangement. The mixture of primary air and pulverized coal 20 is provided to the furnace combustion zone via burner elbow 24, burner nozzle 12 and impeller 58 located at an outlet end 60 of the burner nozzle 12. Secondary air 36 from the windbox 14 is provided to a single adjustable register assembly 61 for each burner nozzle 12. The register assemblies are adjusted by drive means 52, and the impeller 58 is located axially with respect to the outlet end 60 of the burner nozzle 12 by means of a shaft 62.

The cell burner has also undergone significant improvements over the last few years, and finds its most recent embodiment in a design known as the LNCB® burner, a registered trademark of The Babcock & Wilcox Company, (and also known as the Low $NO_x$ Cell™ burner, a trademark of The Babcock & Wilcox Company) which was developed in cooperation with the Electric Power Research Institute to achieve reduced $NO_x$ emissions. As shown in FIGS. 3 and 4, this burner modifies a conventional two-high cell burner to supply all of the pulverized coal fuel to the lower burner throat along with a portion of the secondary air. The upper cell burner nozzle is then converted into an integral $NO_x$ port which supplies the balance of the secondary air at each location. The lower burner of each cell is a circular burner, and is provided with the aforementioned impeller 58 at the outer tip of the burner nozzle 12, and may be provided with either the aforementioned coal deflector 26 and conical diffuser 28 described in connection with the dual register burner 10, supra, or alternatively with a convergent distribution cone 66 upstream thereof, located as described below.

FIG. 5 shows a cross-sectional side view through just the burner nozzle 12 of a conventional burner manufactured by The Babcock & Wilcox Company. The burner comprises burner nozzle 12 and elbow 24 to convey the mixture of primary air and pulverized coal 20 to the outlet end 30 of the burner. Impeller 58, typically conical in configuration (some designs have employed bladed-type impellers) is located at the outlet end 30 of the burner nozzle 12. The impeller 58 is axially adjustable with respect to the outlet end 60 of the burner nozzle 12 by means of shaft 62, which may be supported by support means 64 at an intermediate location along the burner nozzle 12, or by a foot as shown in FIGS. 2 and 3, and disperses the mixture of primary air and pulverized coal 20. As indicated in the immediately preceding paragraph, some circular burners manufactured by The Babcock & Wilcox Company have employed a convergent distribution cone 66 in combination with and upstream of the impeller 58 to provide a desired fuel distribution entering the impeller 58. The impeller 58 is used to disperse the coal into the secondary combustion air to a desired degree and thereby affect flame shape. The convergent distribution cone 66 takes the shape of one half of a frustoconical cone, fixed within the burner nozzle 12 at an inner wall thereof, and is positioned 1.5 nozzle diameters (1.5 D) downstream of and centered at the outer tangential centerline of the burner elbow 24 attached at an inlet end 68 of the burner nozzle 12.

Visual observations (schematically depicted in FIG. 6) made during scaled flow model testing of a burner nozzle 12 employing the aforementioned coal impeller 58 and convergent distribution cone 66 reveal that a rope, depicted as a solid area 70, of particles flowing therethrough tends to oscillate within the burner nozzle 12 and bypass the convergent distribution cone 66 positioned 1.5 diameters downstream of the burner elbow 24. Thus the convergent distribution cone 66 did not break up and bias the rope 70 to the outside walls of the burner nozzle 12 prior to entering the impeller 58.

Further testing was performed to determine the design changes necessary to efficiently break up and disperse a rope of particles within the burner nozzle while improving upon the pressure drop characteristics of the burner nozzle. The results of this testing led to the subject matter of the present invention.

SUMMARY OF THE INVENTION

The present invention solves the problem of coal or fuel particle roping, as well as other problems associated with prior art devices, by providing a pulverized fuel burner having a uniquely formed and located distribution half-cone within a burner nozzle of the burner to produce an improved pulverized fuel burner.

In the burner of the present invention the distribution half-cone is made so that the air and pulverized fuel (typically coal) mixture flows in the converging direction (larger to smaller diameter) through the cone. The cone is formed as a one-half of a converging nozzle with a leading edge thereof facing the air and pulverized coal mixture being formed to have a 30° sharp edge, as measured with respect to a longitudinal axis of the burner nozzle. This sharp edge minimizes pressure drop through the burner nozzle. In contrast to the locations of the convergent distribution cones of the prior art, the distribution half-cone of the present invention is mounted to an inner wall of the burner nozzle just downstream of an exit of a burner elbow connected to an inlet of the burner nozzle. Mounting is preferably accomplished by two streamlined support legs with the centerline of the distribution half-cone always centered at and aligned with an outer tangential centerline of the burner elbow attached at the burner nozzle inlet. The distribution half-cone is designed and sized so that when placed inside the burner nozzle, the outside diameter of the largest portion of the distribution half-cone is sufficiently less than an inside diameter of the burner nozzle pipe to provide a ⅛ to ¼ inch gap between an outer wall of the cone at the largest portion thereof and an inner wall of the burner nozzle, with a 3/16 inch gap being optimum.

The gap is critical, as it allows a first portion (approximately 50%, when the gap is approximately 3/16 inch) of the pulverized fuel rope to flow between the outer wall of the distribution half-cone and the inner wall of the burner nozzle, while a second portion flows past said a side of the distribution half-cone opposite said gap. In other words, about half of the pulverized fuel remains in the top half of the burner nozzle while the remainder of the pulverized fuel is directed downwardly by the distribution half-cone toward the bottom of the burner nozzle.

After the pulverized fuel stream is split and flows through the distribution half-cone, the majority of the pulverized fuel (70% to 80%) is thus biased outwardly towards the inner wall of the burner nozzle. This is the particle distribution desired for optimum combustion.

In view of the foregoing it will be seen that one aspect of the present invention is drawn to an improved pulverized fuel burner that will minimize fuel roping in the burner and achieve good fuel distribution and combustion without using complicated and expensive conical diffusers in combination with deflectors, or convergent distribution cones with or without impellers. The use of impellers is possible with the present invention, but is application dependent, and based upon whether or not it is desired to spread the fuel particles outwardly into the secondary combustion air at the outlet end of the burner to affect flame length and/or shape.

Another aspect of the present invention is drawn to an improved apparatus for minimizing fuel roping in a pulverized fuel burner suitable for new construction as well as retrofitting into existing pulverized fuel burners.

Yet another aspect of the present invention is drawn to an improved pulverized fuel burner having low pressure drop and an optimized fuel mixture distribution.

The various features of novelty which characterize the present invention are pointed out with particularity in the claims annexed to and forming a part of this disclosure. For a better understanding of the present invention, its operating advantages and the benefits obtained through its uses, reference is made to the accompanying drawings and descriptive matter in which preferred embodiments of the invention are illustrated.

DESCRIPTION OF THE PREFERRED EMBODIMENTS

Figure 1:
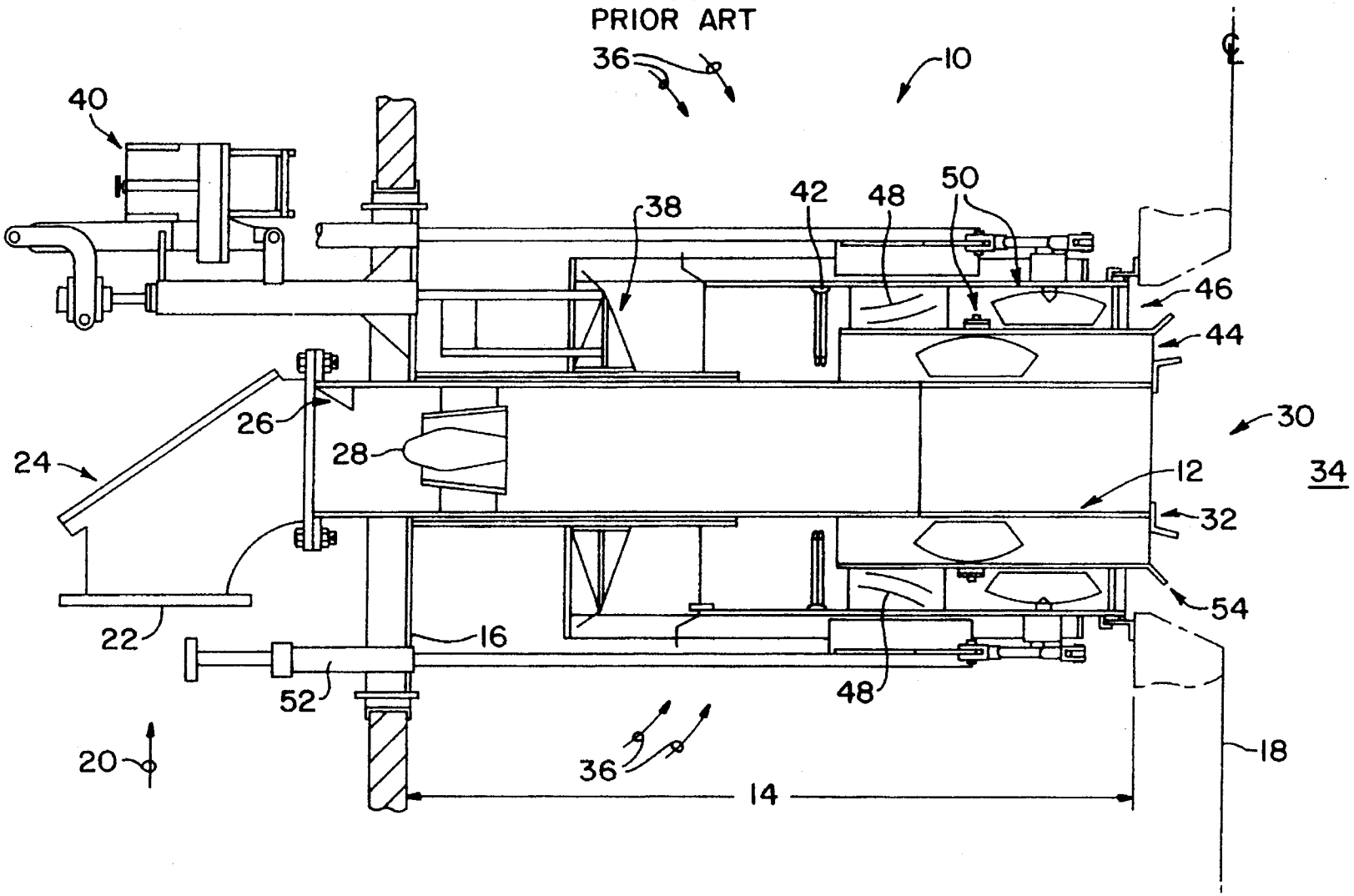
FIG. 1 PRIOR ART
FIG. 1 is a cross-sectional side view of a prior art, dual register burner having a coal deflector and a conical diffuser mounted therein.
Figure 2:
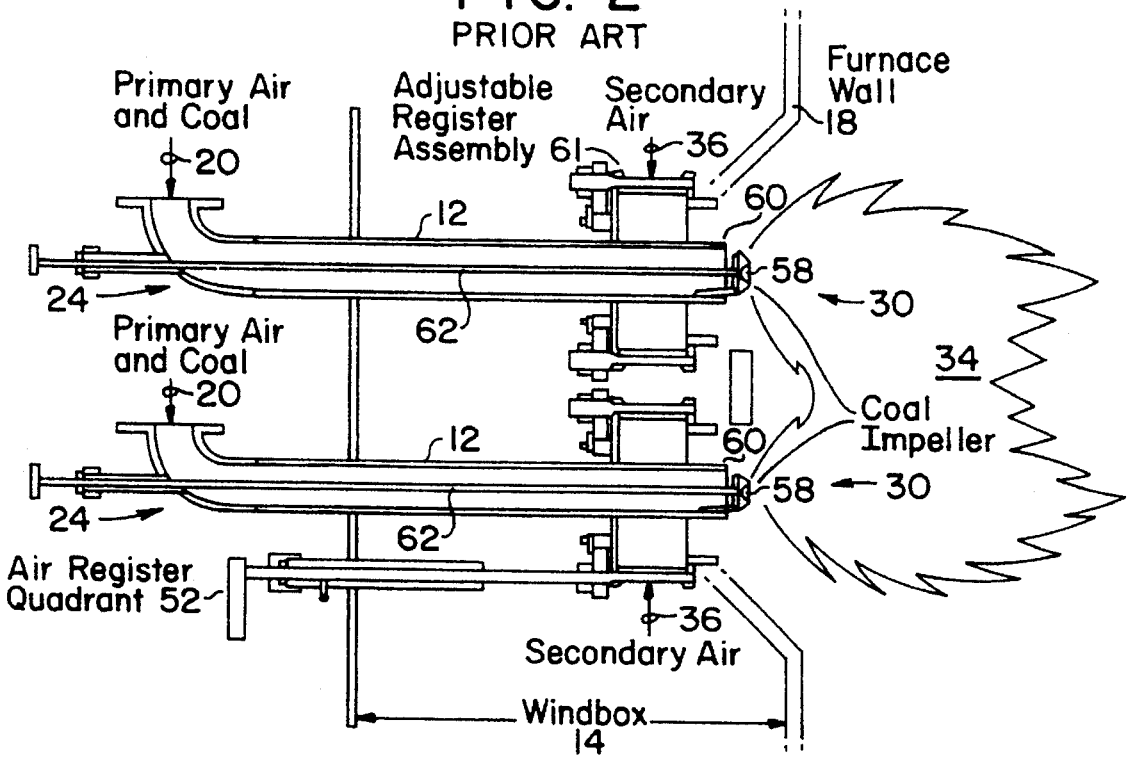
FIG. 2 PRIOR ART
FIG. 2 is a cross-sectional side view of a prior art, two-high, cell burner arrangement having coal impellers located at outlet ends of the burner nozzles.
Figure 3:
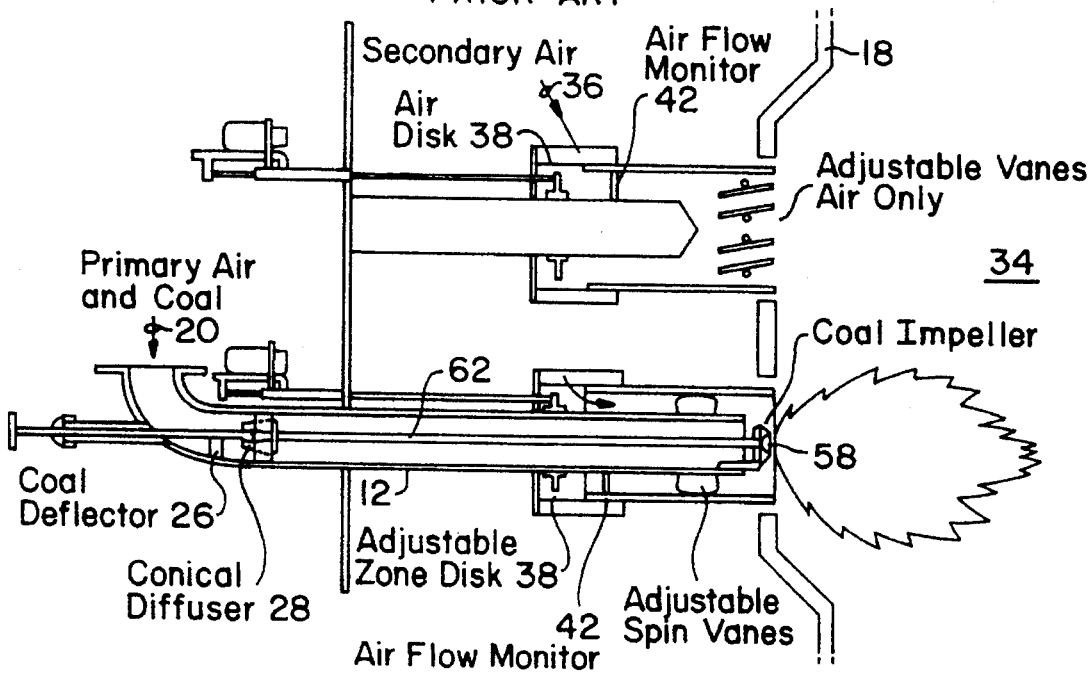
FIG. 3 PRIOR ART
FIG. 3 is a cross-sectional side view of a prior art, LNCB® burner, manufactured by The Babcock & Wilcox Company, wherein the lower burner nozzle is provided with a coal deflector and conical diffuser at an inlet end of the burner, and a coal impeller located at an outlet end of the burner nozzle.
Figure 4:
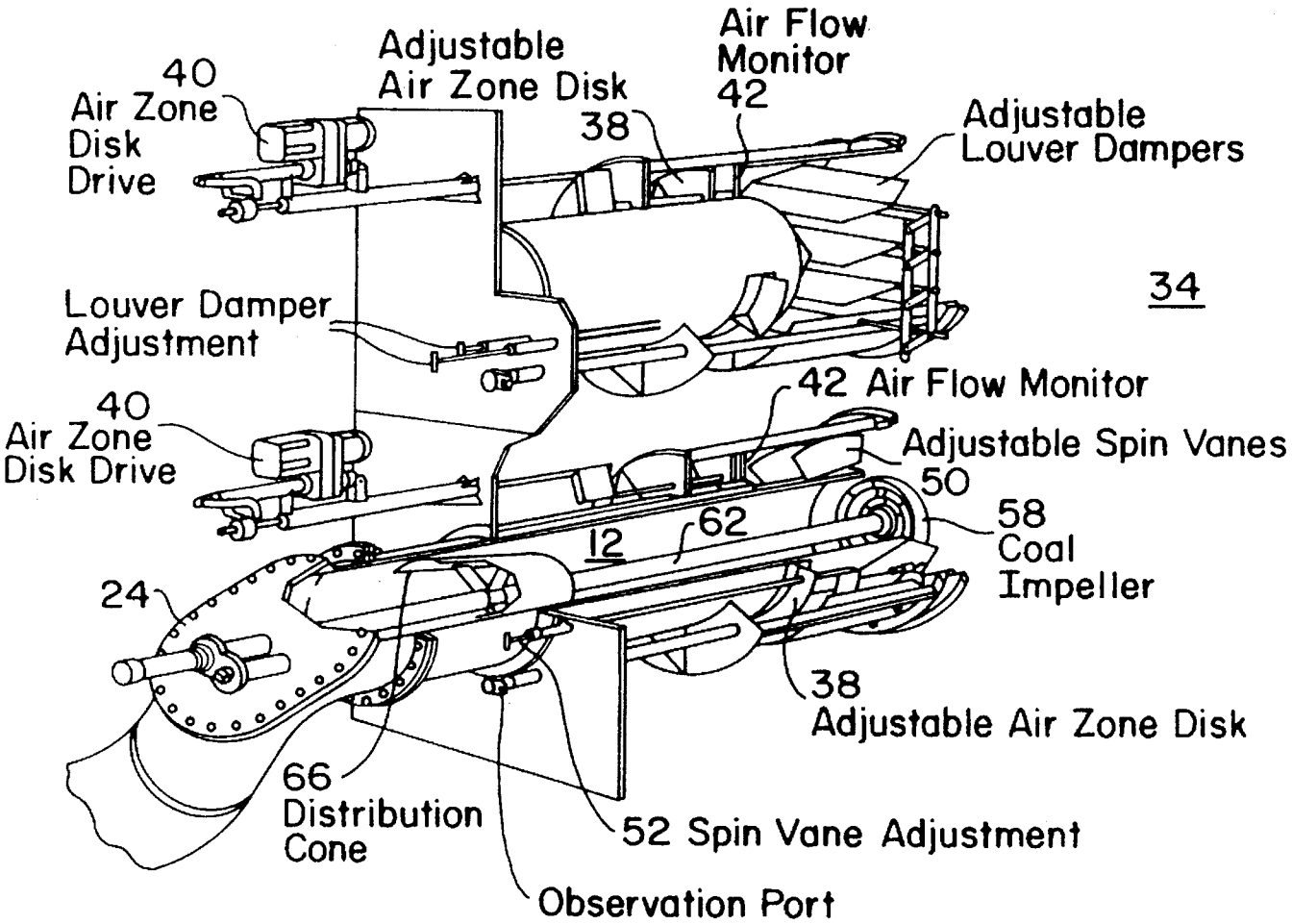
FIG. 4 PRIOR ART
FIG. 4 is a perspective view of a prior art, LNCB® burner, manufactured by The Babcock & Wilcox Company, wherein the lower burner nozzle is provided with a convergent distribution cone located 1.5 diameters downstream of the inlet elbow to the burner nozzle, and a coal impeller located at an outlet end of the burner nozzle.

The present description is intended to disclose the preferred embodiment of the present invention but is not intended to limit it thereto. Like reference numerals represent the same or functionally similar elements throughout the several drawings.

With particular reference to the prior art shown in FIGS. 1–6, it is seen that previous approaches to solving coal roping utilized certain biasing devices to bias the pulverized coal outwardly towards an inner wall surface of the burner nozzle 12 prior to exiting the fuel from the burner nozzle 12 for combustion. The convergent distribution cone 66, positioned 1.5 diameters D downstream of the burner elbow 24, was to provide the desired pulverized coal distribution prior to entering the coal impeller 58 located at an outlet end 60 of the burner nozzle 12. The coal impeller 58 disperses the pulverized coal stream outwardly into the secondary combustion air to effect a desired flame length and/or shape.

Figure 5:
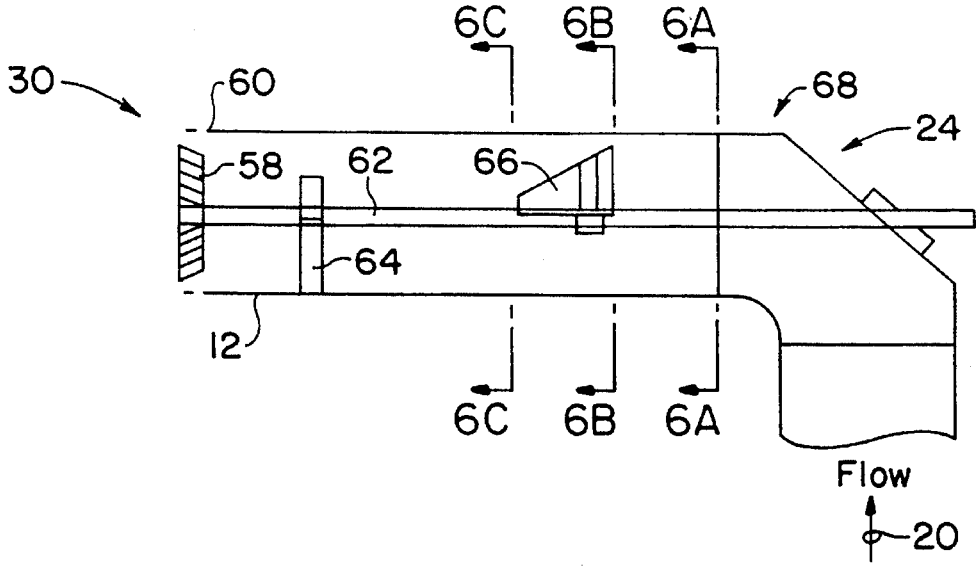
FIG. 5 PRIOR ART
FIG. 5 is a cross-sectional side view through just the burner nozzle of a conventional burner manufactured by The Babcock & Wilcox Company, wherein the burner nozzle is provided with a convergent distribution cone located 1.5 diameters downstream of the inlet elbow to the burner nozzle, and a coal impeller located at an outlet end of the burner nozzle.
Figure 6A:
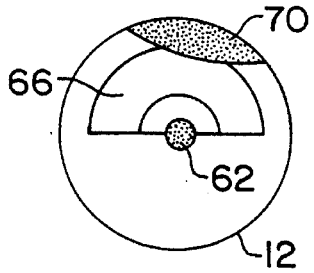
FIG. 6A PRIOR ART
FIG. 6 is a schematic depiction of visual observations of a rope of particles at sections A—A, B—B, and C—C of the burner of FIG. 5 made during scaled flow model testing of a burner nozzle employing a prior art impeller, and a prior art convergent distribution cone positioned according to the teachings of the prior art at 1.5 diameters downstream of a burner elbow.
Figure 6B:
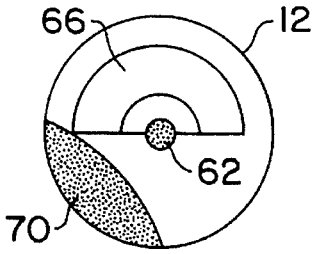
FIG. 6B PRIOR ART
Figure 6C:
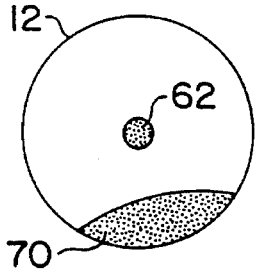
FIG. 6C PRIOR ART

As shown in FIGS. 5 and 6, recent visual observations (schematically depicted in FIG. 6) made during scaled flow model testing of a burner nozzle 12 employing the aforementioned coal impeller 58 and convergent distribution cone 66 reveal that a rope, depicted as solid area 70, of particles flowing therethrough tends to oscillate within the burner nozzle 12 and bypass the convergent distribution cone 66 positioned 1.5 diameters downstream of the burner elbow 24. Thus the convergent distribution cone 66 is effectively bypassed when the convergent distribution cone 66 is located 1.5 diameters D downstream of the elbow 24 and does not break up and bias the rope 70 to the outside wall of the burner nozzle 12 prior to entering the impeller 58. As used herein, "diameter" refers to the inside diameter dimension D of the burner nozzle 12.

With further reference to FIGS. 5 and 6, it is seen that the rope of particles 70 appears 15 in front of the top of the convergent distribution cone 66 as it leaves the elbow 24 at section A—A. At the entrance to the convergent distribution cone 66, as seen at section B—B, the rope 70 is below the convergent distribution cone 66. Thus the rope 70 misses the convergent distribution cone 66 and fails to be distributed thereby around the outside wall of the burner nozzle 12. Section C—C of the burner nozzle 12 verifies that the rope 70 bypasses the convergent distribution cone 66 by showing that the rope 70 is not uniformly distributed at the outlet C—C of the convergent distribution cone 66.

It will be noted that the particles used in the visual observations were not coal particles, but small vinyl resin particles having a size and density comparable to the coal particles such a burner nozzle 12 would convey during burner operation.

Further testing was performed to determine the design changes necessary to efficiently break up and distribute a rope of particles within the burner nozzle 12 while improving upon the pressure drop characteristics of the burner nozzle. This testing led to the development of a uniquely configured distribution half-cone elongated member 80 which is uniquely placed in the burner nozzle 12 to provide a low pressure drop burner nozzle with more uniform fuel distribution therein.

Figure 8:
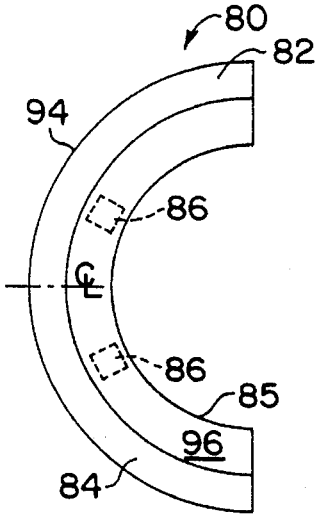
FIG. 8 is an end view of the distribution half-cone of FIG. 7.
Figure 7:
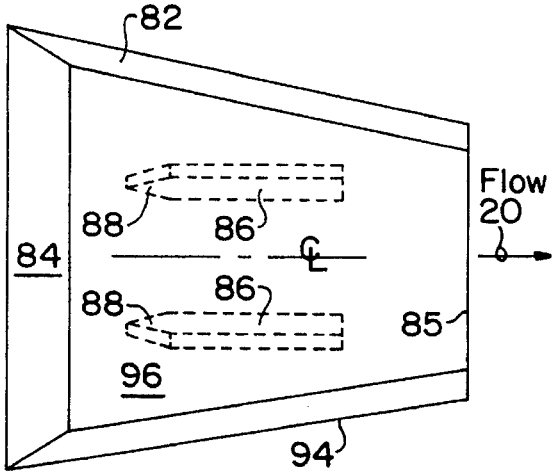
FIG. 7 depicts an underside view of the distribution half-cone of the present invention.
Figure 9:
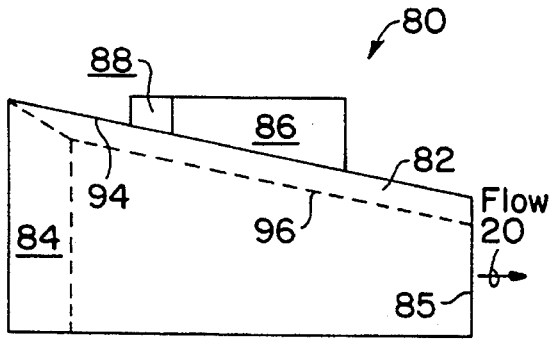
FIG. 9 is a side view of the distribution half-cone of FIG. 7.

FIGS. 7 through 9 disclose certain features of the distribution half-cone 80 according to the present invention. The distribution half-cone 80 is preferably formed from erosion-resistant ceramic material as one-half of a converging nozzle 82 having a substantial thickness of approximately 0.5 inch. The length L and the diameter D were proportioned at the optimal ratio of L=1.06 D which ratio was determined by empirical data. A leading edge 84 of the converging half-nozzle 82 is cut to have a sharp edged slope, desirably within a range of approximately 15° to 45° and preferably 30°, to minimize pressure drop as the pulverized fuel and air mixture 20 flows therethrough within the burner nozzle 12. An outlet 85 is formed to have a opening of 0.6 D.

The distribution half-cone 80 has a pair of streamlined, elongated mounting support legs 86 which may be welded or fastened to the inside wall of the burner nozzle 12 to mount the distribution half-cone 80 therein.

Each streamlined mounting leg 86 is preferably formed integrally with the converging half-nozzle 82 and are also made from the same erosion-resistant ceramic material. Each leg 86 has a leading edge 88 also formed at an angle desirably within a range of approximately 15° to 45° and preferably 30° to minimize pressure drop during the flow of the pulverized fuel and air mixture 20 past the mounting legs 86. For this same reason, these legs 86 were also empirically optimized to have a width of approximately 0.5 inch and a length of L/2 with the legs 86 being located at 90° with respect to each other at a distance of L/4 from the leading edge 84 of the converging half-nozzle 82.

Figure 10:
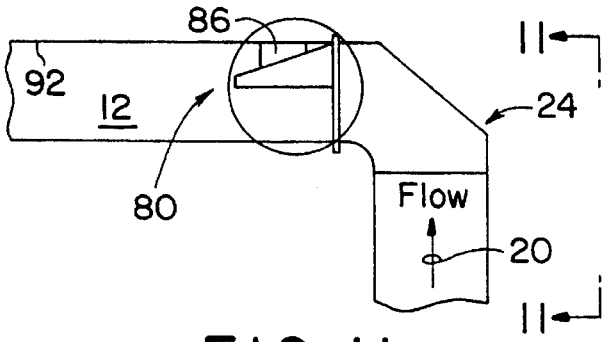
FIG. 10 is a cross-sectional side view of a burner nozzle showing the unique placement of the distribution half-cone of the present invention at the outlet of the burner elbow.
Figure 11:
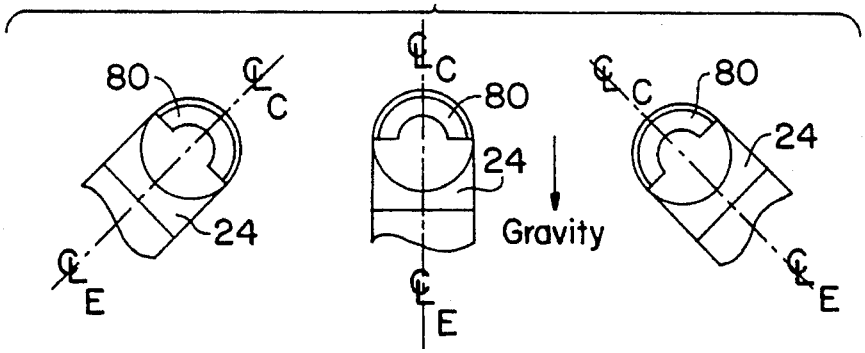
FIG. 11 is an end view taken in the direction of arrows A—A of FIG. 10 showing the orientation of the top centerlines of the distribution half-cone, $\underline{\underline{\mathbf{C}}}_C$, and of the burner elbow, $\underline{\underline{\mathbf{C}}}_E$, are aligned, regardless of elbow orientation with respect to the force of gravity.
Figure 12:
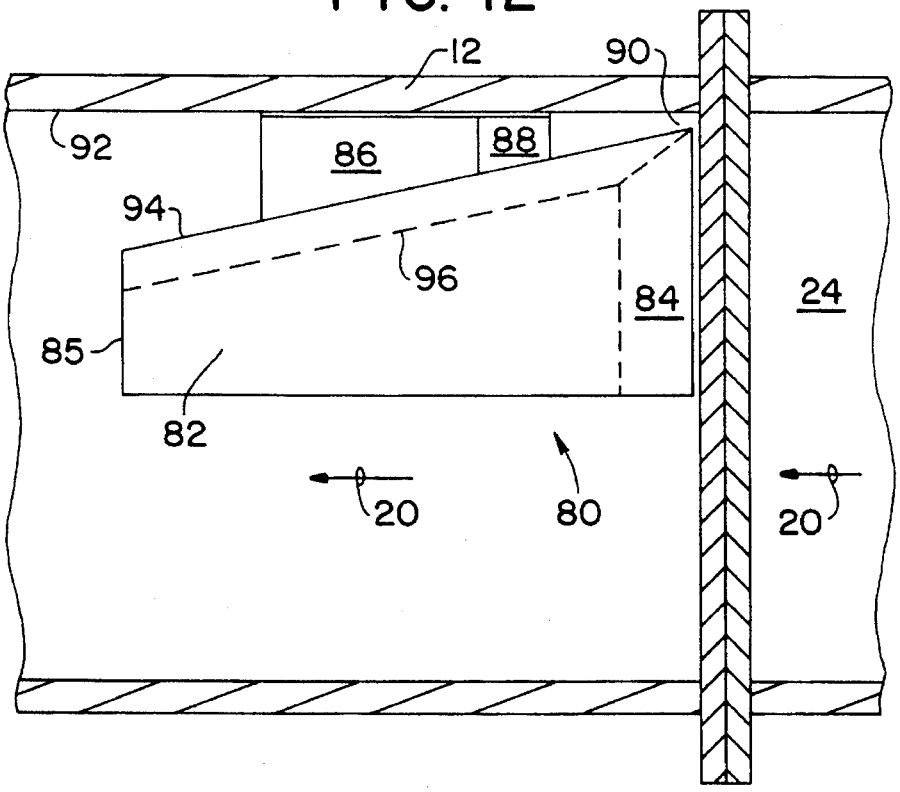
FIG. 12 is an expanded view of the circled portion of FIG. 10 showing the mounting of the distribution half-cone of the present invention in a burner nozzle to provide a gap therebetween.
Figure 13:
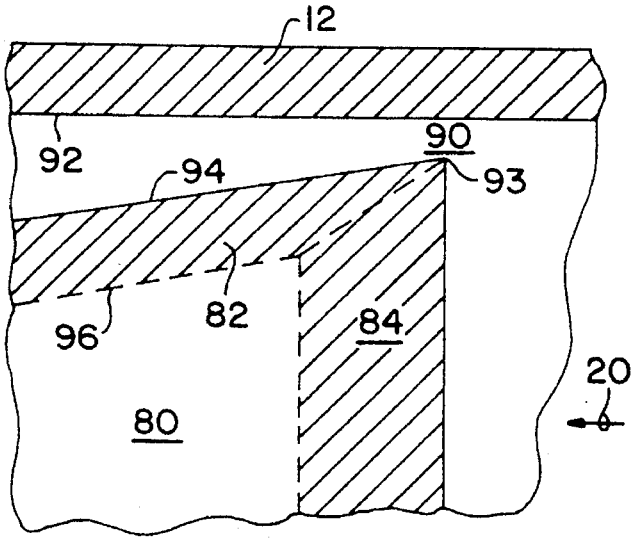
FIG. 13 is a further expanded view of the circled portion of FIG. 10 showing the gap in greater detail.
Figure 14:
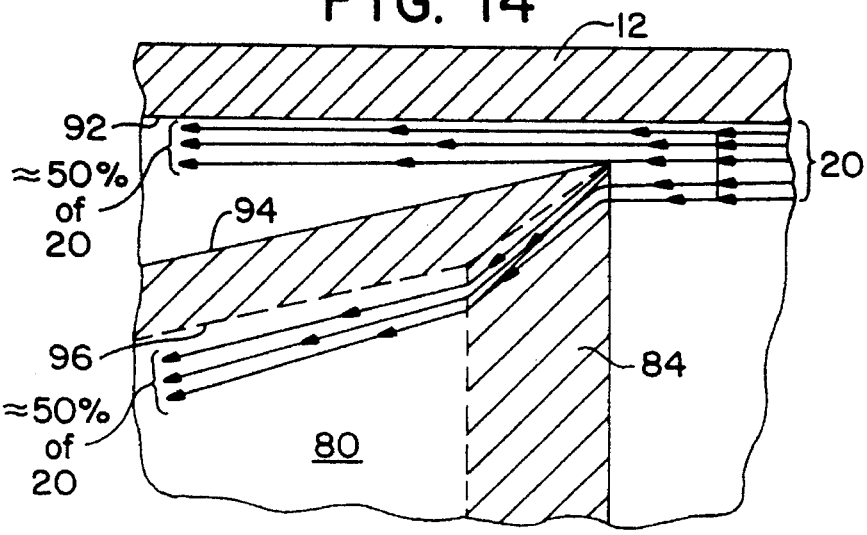
FIG. 14 depicts the flow of particles past the distribution half-cone of the present invention as installed in the burner nozzle of FIGS. 10 through 13.

The distribution half-cone 80 is placed in the burner nozzle 12, mounted to the inside wall of the burner nozzle 12 immediately at the exit of the burner elbow 24, rather than 1.5 diameters D away as in the prior art devices, by welding or fastening the support legs 86 to the burner nozzle 12. As shown in FIGS. 10 and 11, the top centerline $\underline{\mathbb{C}}_C$ of the distribution half-cone 80 is oriented to be aligned with the top centerline $\underline{\mathbb{C}}_E$ of the burner elbow 24, regardless of burner elbow 24 orientation with respect to the force of gravity, and to have the leading edge 84 facing the outlet of and proximate to the exit of the burner elbow 24. As shown in FIGS. 12 through 14, a gap 90 of ⅛ inch to ¼ inch is maintained between inside wall 92 of the burner nozzle 12 and a top edge 93 of the half-cone 80 with a 3/16 inch gap being optimum. This gap 90 is critical to the operation of the invention as it allows a first portion (approximately 50% when the gap is approximately 3/16 inch) of the coal rope exiting the burner elbow 24 to flow between an outer wall 94 of the converging half-nozzle 82 and the inside wall 92 of the burner nozzle 12 as is depicted in FIG. 14, while a second portion flows past a side of said distribution half-cone 80 opposite said gap 90; i.e., the other 50% of the coal rope flows through the distribution half-cone 80 along an inner wall 96 thereof. After exiting the distribution half-cone 80, the pulverized coal stream recombines to have the majority of the pulverized coal fuel (70% to 80%) biased outwardly towards the inside wall 92 of the burner nozzle 12. This is the particle distribution desired for optimum burner combustion.

A comparison of the prior art devices of FIGS. 1–6 will show that the half-cone, 80 could be easily retrofitted into such burners to produce a burner with less pressure drop, less coal roping, and improved life due to the ceramic material construction and unique placement of the distribution half-cone 80.

Figure 15:
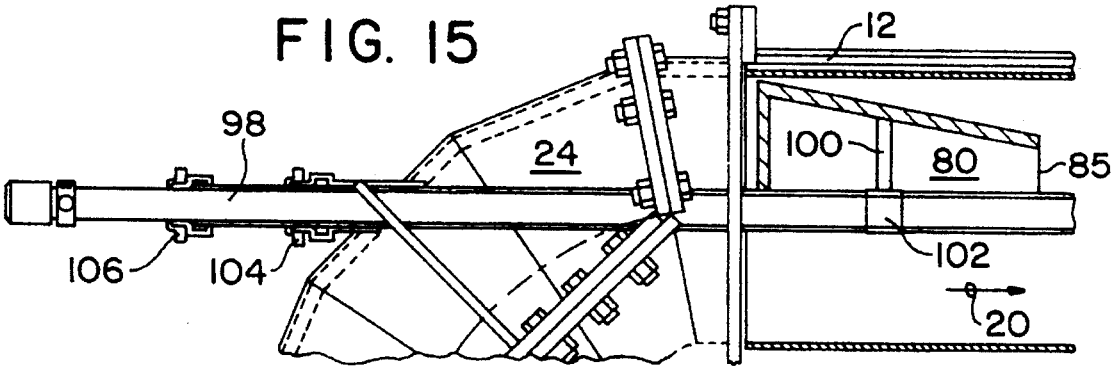
FIG. 15 depicts an alternate mounting of the distribution half-cone of the present invention in a burner nozzle.

There are burner line configurations in which mounting the distribution half-cone 80 in one fixed position would not be desirable due to concerns about emission control. In these cases, the distribution half-cone 80 can be positioned within the burner nozzle 12 via a dual rod and port seal 98 as shown in FIG. 15. Here the mounting support legs 86 of the distribution half-cone 80 are removed, and three struts 100 are connected to a ring collar 102 and used to position the distribution half-cone 80 upon the dual rod and port seal 98. The dual rod and port seal 98 is designed such that the distribution half-cone 80 can be positioned within the burner nozzle 12 independently of the axial position of an impeller 58, if it is determined that an impeller 58 should be used to control flame shape. The dual rod and port seal 98 design has been used successfully on other burner designs with oil guns and impellers which run down along the axial centerline of the burner nozzle 12. A first slidably mounted rod 104 would be used to axially position the distribution half-cone 80 attached thereto, while a second slidably mounted rod 106 would be used to axially position an impeller, an oil gun, or other apparatus attached thereto.

Certain improvements and modifications have been deleted herein for the sake of conciseness and readability but are intended to be within the scope of the following claims. As an example, while fabrication of the invention with wear-resistant ceramic materials is preferred for superior erosion resistance and longer operational life, the invention can be fabricated out of carbon or stainless steel. This will result in simpler fabrication (standard heat forming and welding) at lower cost. Further, while the present invention has been shown and described as being applicable to pulverized coal combustion methods and apparatus, it will be readily appreciated by those skilled in the art that the invention can provide similar distribution effects with other pulverized fuels having similar particle sizes and densities. The terms "coal roping" or "fuel roping" are thus used in a broad sense to encompass any type of fuel particle roping wherein undesirable fuel particles separation occurs within the burner nozzle of the burner. Thus while specific embodiments and applications of the invention have been shown and described in detail to illustrate the application of the principles of the invention, it will be understood that the invention may be embodied otherwise and/or applied to various types of pulverized or granular fuels without departing from the principles of the invention, and all such variations fall within the scope and equivalents of the following claims.

We claim:

1. An apparatus for minimizing fuel roping in a pulverized fuel burner, comprising:

a distribution half-cone formed from ceramic material of substantial thickness and formed to have an inlet of a first diameter and an outlet of a second diameter smaller than said first diameter, said inlet being formed as a sharp edge nozzle formed at an angle within a range of approximately 15° to 45° from an outside edge of said inlet along the substantial thickness to an inside diameter of said distribution half-cone to form a sharp edge slope at the nozzle inlet to minimize pressure drop across said distribution half-cone to pulverized fuel flow therethrough; and mounting means for mounting said distribution half-cone within a burner nozzle of the pulverized fuel burner so as to provide a gap between said burner nozzle and said distribution half-cone for splitting a flow of pulverized fuel therethrough into a first portion flowing through said gap and a second portion flowing past a side of said distribution half-cone opposite said gap when said distribution half-cone is installed within said burner nozzle.

2. The apparatus for minimizing fuel roping as set forth in claim 1, wherein said inlet is formed at approximately a 30° angle from an outside edge of said inlet along the substantial thickness to an inside diameter of said distribution half-cone to form a sharp edge slope at the nozzle inlet.

3. The apparatus for minimizing fuel roping as set forth in claim 1, wherein said mounting means includes a pair of streamlined, elongated members formed along a top of said distribution half-cone for mounting said distribution half-cone within the burner nozzle of said pulverized fuel burner to provide a gap within a range of approximately ¼–⅛ inch between an inside wall of the burner nozzle and a top edge of said inlet of said distribution half-cone.

4. The apparatus for minimizing fuel roping as set forth in claim 3, wherein said pair of streamlined, elongated members formed along a top of said distribution half-cone provide a gap of approximately 3/16 inch between an inside wall of the burner nozzle and a top edge of said inlet of said distribution half-cone.

5. The apparatus for minimizing fuel roping as set forth in claim 3, wherein each of said streamlined, elongated members has a leading edge formed at an angle within a range of approximately 15° to 45° at said inlet side of said distribution half-cone.

6. The apparatus for minimizing fuel roping as set forth in claim 5, wherein said leading edge is formed at approximately a 30° angle at said inlet side of said distribution half-cone.

7. The apparatus for minimizing fuel roping as set forth in claim 3, wherein each of said streamlined, elongated members is approximately half the length of said distribution half-cone and has a leading edge formed at an angle within a range of approximately 15° to 45° at said inlet side extending along the top of said distribution half-cone a distance of one fourth the length of said distribution half-cone from the inlet side thereof.

8. The apparatus for minimizing fuel roping as set forth in claim 7, wherein each of said leading edges is formed at approximately a 30° angle at said inlet side of said distribution half-cone.

9. The apparatus for minimizing fuel roping as set forth in claim 3, wherein said streamlined, elongated members are spaced approximately 90° apart from each other.

10. A burner for pulverized fuel, comprising:

a fuel inlet, an elbow section connected to said fuel inlet, and an elongated, substantially circular burner nozzle connected to said elbow section for exhausting a flow of pulverized fuel for combustion; and a distribution half-cone mounted within said burner nozzle at the outlet of said elbow section so as to provide a gap within a range of approximately ¼–⅛ inch between said burner nozzle and said distribution half-cone for splitting the flow of pulverized fuel into a first portion flowing through said gap and a second portion flowing past a side of said distribution half-cone opposite said gap.

11. A burner for pulverized fuel as set forth in claim 10, wherein said distribution half-cone is mounted within the burner nozzle so that a top centerline of the distribution half-cone is oriented to be aligned with a top centerline of the burner elbow, regardless of burner elbow orientation with respect to the force of gravity.

12. A burner for pulverized fuel as set forth in claim 10, wherein said gap is approximately 3/16 inch to provide a 50/50 split of the first and second portions of pulverized fuel flowing through said gap and past a side of said distribution half-cone opposite said gap.

13. A burner for pulverized fuel as set forth in claim 10, wherein said inlet of said distribution half-cone is formed as a sharp edge nozzle to minimize pressure drop across said distribution half-cone to pulverized fuel flow therethrough.

14. A burner for pulverized fuel as set forth in claim 10, wherein said distribution half-cone is formed from ceramic material of substantial thickness and said inlet is formed at an angle within a range of approximately 15° to 45° from an outside edge of said inlet along the substantial thickness to an inside diameter of said distribution half-cone to form a sharp edge slope at the nozzle inlet.

15. A burner for pulverized fuel as set forth in claim 14, wherein said inlet is formed at approximately a 30° angle from an outside edge of said inlet along the substantial thickness to an inside diameter of said distribution half-cone to form a sharp edge slope at the nozzle inlet.

16. A burner for pulverized fuel as set forth in claim 10, including mounting means for mounting said distribution half-cone within said burner nozzle to provide said gap.

17. A burner for pulverized fuel as set forth in claim 16, wherein said mounting means includes a pair of streamlined, elongated members formed along a top of said distribution half-cone to provide the gap within a range of approximately ¼–⅛ inch between an inside wall of the burner nozzle and a top edge of said inlet of said distribution half-cone.

18. A burner for pulverized fuel as set forth in claim 17, wherein said pair of streamlined, elongated members formed along a top of said distribution half-cone for mounting said distribution half-cone within the burner nozzle of said pulverized fuel burner provide a gap of approximately 3/16 inch between an inside wall of the burner nozzle and a top edge of said inlet of said distribution half-cone.

19. A burner for pulverized fuel as set forth in claim 10, including a pair of streamlined, elongated members for mounting said distribution half-cone within said burner nozzle to provide said gap, and wherein each of said elongated members has a leading edge formed at an angle within a range of approximately 15° to 45° at said inlet side of said distribution half-cone.

20. A burner for pulverized fuel as set forth in claim 19, wherein each of said streamlined, elongated members has a leading edge formed at approximately a 30° angle at said inlet side of said distribution half-cone.

21. A burner for pulverized fuel as set forth in claim 17, wherein each of said streamlined, elongated members is approximately half the length of said distribution half-cone and has a leading edge formed at an angle within a range of approximately 15° to 45° at said inlet side extending along the top of said distribution half-cone a distance of one fourth the length of said distribution half-cone from the inlet side thereof.

22. A burner for pulverized fuel as set forth in claim 21, wherein said leading edge of each of said streamlined, elongated members is formed at approximately a 30° angle at said inlet side.

23. A burner for pulverized fuel as set forth in claim 19, wherein said streamlined, elongated members are spaced approximately 90° apart from each other.

24. An apparatus for minimizing fuel roping in a pulverized fuel burner, comprising:

a distribution half-cone formed from steel material of substantial thickness and formed to have an inlet of a first diameter and an outlet of a second diameter smaller than said first diameter, said inlet being formed as a sharp edge nozzle formed at an angle within a range of approximately 15° to 45° from an outside edge of said inlet along the substantial thickness to an inside diameter of said distribution half-cone to form a sharp edge slope at the nozzle inlet to minimize pressure drop across said distribution half-cone to pulverized fuel flow therethrough; and mounting means for mounting said distribution half-cone within a burner nozzle of the pulverized fuel burner so as to provide a gap between said burner nozzle and said distribution half-cone for splitting a flow of pulverized fuel therethrough into a first portion flowing through said gap and a second portion flowing past a side of said distribution half-cone opposite said gap when said distribution half-cone is installed within said burner nozzle.

25. The apparatus for minimizing fuel roping as set forth in claim 24, wherein said mounting means for mounting said distribution half-cone within a burner nozzle provides a gap within a range of approximately ¼–⅛ inch between an inside wall of said burner nozzle and a top edge of said inlet of said distribution half-cone when the latter is installed within said burner nozzle.

26. The apparatus for minimizing fuel roping as set forth in claim 24, wherein said steel material is stainless steel.

27. An apparatus for minimizing fuel roping in a pulverized fuel burner, comprising:

a distribution half-cone formed to have an inlet of a first diameter and an outlet of a second diameter smaller than said first diameter, said inlet being formed as a sharp edge nozzle to minimize pressure drop across said distribution half-cone to pulverized fuel flow therethrough; and mounting means for mounting said distribution half-cone within a burner nozzle of the pulverized fuel burner, said mounting means including a pair of streamlined, elongated members formed along a top of said distribution half-cone and spaced approximately 90° apart from each other for mounting said distribution half-cone within the burner nozzle of said pulverized fuel burner to provide a gap within a range of approximately ¼–⅛ inch between an inside wall of the burner nozzle and a top edge of said inlet of said distribution half-cone.

28. An apparatus for minimizing fuel roping in a pulverized fuel burner, comprising:

a distribution half-cone formed to have an inlet of a first diameter and an outlet of a second diameter smaller than said first diameter, said inlet being formed as a sharp edge nozzle to minimize pressure drop across said distribution half-cone to pulverized fuel flow therethrough; and mounting means for mounting said distribution half-cone within a burner nozzle of the pulverized fuel burner so as to provide a gap within a range of approximately ¼–⅛ inch between an inside wall of the burner nozzle and a top edge of said inlet of said distribution half-cone for splitting a flow of pulverized fuel therethrough into a first portion flowing through said gap and a second portion flowing past a side of distribution half-cone opposite said gap when said distribution half-cone is installed within said burner nozzle.

29. The apparatus for minimizing fuel roping as set forth in claim 28, wherein said mounting means for mounting said distribution half-cone within a burner nozzle provides a gap of approximately 3/16 inch between an inside wall of said burner nozzle and a top edge of said inlet of said distribution half-cone when the latter is installed within said burner nozzle.

30. A burner for pulverized fuel, comprising:

a fuel inlet, an elbow section connected to said fuel inlet, and an elongated, substantially circular burner nozzle connected to said elbow section for exhausting a flow of pulverized fuel for combustion; and a distribution half-cone formed from ceramic material of substantial thickness and having an inlet formed at an angle within a range of approximately 15° to 45° from an outside edge of said inlet along the substantial thickness to an inside diameter of said distribution half-cone to form a sharp edge slope at the nozzle inlet, said distribution half-cone being mounted within said burner nozzle at the outlet of said elbow section so as to provide a gap between said burner nozzle and said distribution half-cone for splitting the flow of pulverized fuel into a first portion flowing through said gap and a second portion flowing past a side of said distribution half-cone opposite said gap.

31. A burner for pulverized fuel as set forth in claim 30, wherein said inlet is formed at approximately a 30° angle from an outside edge of said inlet along the substantial thickness to an inside diameter of said distribution half-cone to form a sharp edge slope at the nozzle inlet.

32. A burner for pulverized fuel, comprising:

a fuel inlet, an elbow section connected to said fuel inlet, and an elongated, substantially circular burner nozzle connected to said elbow section for exhausting a flow of pulverized fuel for combustion;

a distribution half-cone having an inlet; and a pair of streamlined, elongated members formed along a top of said distribution half-cone for mounting said distribution half-cone within said burner nozzle at the outlet of said elbow section so as to provide a gap within a range of approximately ¼–⅛ inch between an inside wall of the burner nozzle and a top edge of said inlet of said distribution half-cone for splitting the flow of pulverized fuel into a first portion flowing through said gap and a second portion flowing past a side of said distribution half-cone opposite said gap.

33. A burner for pulverized fuel as set forth in claim 32, wherein said gap is approximately 3/16 inch.

34. A burner for pulverized fuel as set forth in claim 32, wherein each of said streamlined, elongated members is approximately half the length of said distribution half-cone and has a leading edge formed at an angle within a range of approximately 15° to 45° at said inlet side extending along the top of said distribution half-cone a distance of one fourth the length of said distribution half-cone from the inlet side thereof.

35. A burner for pulverized fuel as set forth in claim 34, wherein said leading edge is formed at approximately a 30° angle at said inlet side.

36. A burner for pulverized fuel, comprising:

a fuel inlet, an elbow section connected to said fuel inlet, and an elongated, substantially circular burner nozzle connected to said elbow section for exhausting a flow of pulverized fuel for combustion;

a distribution half-cone mounted within said burner nozzle at the outlet of said elbow section so as to provide a gap between said burner nozzle and said distribution half-cone for splitting the flow of pulverized fuel into a first portion flowing through said gap and a second portion flowing past a side of said distribution half-cone opposite said gap; and a pair of streamlined, elongated members for mounting said distribution half-cone within said burner nozzle to provide said gap, and wherein each of said elongated members has a leading edge formed at an angle within a range of approximately 15° to 45° at said inlet side of said distribution half-cone.

37. A burner for pulverized fuel as set forth in claim 36, wherein each of said elongated members has a leading edge formed at approximately a 30° angle at said inlet side of said distribution half-cone.

38. A burner for pulverized fuel as set forth in claim 36, wherein said streamlined, elongated members are spaced approximately 90° apart from each other.

* * * * *